US006688464B2

(12) United States Patent
Jessen et al.

(10) Patent No.: US 6,688,464 B2
(45) Date of Patent: Feb. 10, 2004

(54) COVER FOR A ROLL OF CONTAMINANT REMOVAL TAPE

(75) Inventors: Todd J. Jessen, St. Paul, MN (US); Andrew C. Anderson, Hudson, WI (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 10/011,139

(22) Filed: Nov. 9, 2001

(65) Prior Publication Data

US 2003/0089632 A1 May 15, 2003

(51) Int. Cl.[7] ..... A45C 11/26
(52) U.S. Cl. ..... 206/349
(58) Field of Search ..... 15/104.002, 247, 15/248.2; 53/473; 206/349, 361, 397, 398, 402, 446, 306, 209, 388, 419, 411, 389

(56) References Cited

U.S. PATENT DOCUMENTS

| | | | | |
|---|---|---|---|---|
| 2,401,842 A | * | 6/1946 | Slater | 15/104.002 |
| 3,192,548 A | | 7/1965 | Wilbrecht | |
| 3,381,325 A | | 5/1968 | Reineman | |
| 3,421,170 A | | 1/1969 | Thomas, Jr. | |
| 3,623,179 A | | 11/1971 | Roth | |
| 3,742,547 A | | 7/1973 | Sohmer | |
| 3,906,578 A | | 9/1975 | Huber | |
| 3,918,920 A | * | 11/1975 | Barber | 206/306 |
| 4,361,923 A | | 12/1982 | McKay | |
| 4,399,579 A | | 8/1983 | McKay | |
| 4,422,201 A | | 12/1983 | McKay | |
| D281,654 S | | 12/1985 | Bladh et al. | |
| D288,973 S | | 3/1987 | Hamazaki | |
| 4,905,337 A | | 3/1990 | McKay | |
| 4,979,614 A | * | 12/1990 | Ruhaut | 206/419 |
| 5,027,465 A | | 7/1991 | McKay | |
| 5,074,098 A | * | 12/1991 | Filipchuk | 206/209 |
| D336,784 S | | 6/1993 | Yen | |

(List continued on next page.)

FOREIGN PATENT DOCUMENTS

| | | |
|---|---|---|
| JP | 8-322778 | 12/1996 |
| JP | 9-75293 | 3/1997 |
| WO | WO 83/01734 | 5/1983 |

OTHER PUBLICATIONS

Product Description/Information Sheet entitled "Carpet Roller," translated from Japanese, Azumae Co., Ltd., date unknown.

(List continued on next page.)

*Primary Examiner*—Jim Foster
(74) *Attorney, Agent, or Firm*—Melissa E. Buss; Kevin H. Rhodes

(57) ABSTRACT

A cover for a roll of contaminant removal tape and methods of placing an applicator inside a cover. The cover includes a wall that defines a cavity, where the cavity includes a first end and a second end opposite the first end, and where the first end of the cavity is open to receive a roll of contaminant removal tape and a slot for receiving a handle attached to the roll of contaminant removal tape, where the slot includes a first end and a second end opposite the first end, where the first end of the slot is open to receive the handle attached to the roll of contaminant removal tape, and where the second end of the slot is closed to contain the handle attached to the roll of contaminant removal tape.

31 Claims, 5 Drawing Sheets

U.S. PATENT DOCUMENTS

| | | | | | |
|---|---|---|---|---|---|
| 5,333,341 | A | | 8/1994 | Heneveld | |
| 5,338,300 | A | | 8/1994 | Cox | |
| 5,641,075 | A | * | 6/1997 | Mechlin | 206/419 |
| 5,709,301 | A | * | 1/1998 | Couch et al. | 206/361 |
| 5,763,038 | A | | 6/1998 | Wood | |
| D396,906 | S | | 8/1998 | Medici | |
| 5,924,157 | A | | 7/1999 | Barela | |
| 5,940,921 | A | | 8/1999 | Wood et al. | |
| 6,055,695 | A | | 5/2000 | McKay, Jr. | |
| 6,127,014 | A | | 10/2000 | McKay, Jr. | |

OTHER PUBLICATIONS

"Nitoms Colo–colo Cleaner", [retrieved from internet on Feb. 11, 2002], URL http://www.nitoms.com/seihin/2_b.html, and http://www.nitoms.com/kaisha/1_c.html 4 pages, in Japanese (translation attached) by Nitoms Inc., 2000.

Ser. No. 29/151,674, filed Nov. 9, 2001.

Ser. No. 29/151,486, filed Nov. 8, 2001.

* cited by examiner

COVER FOR A ROLL OF CONTAMINANT REMOVAL TAPE

TECHNICAL FIELD

The present invention relates generally to a cover for a roll of contaminant removal tape and methods of placing an applicator inside a cover. The present invention relates more particularly to a cover that includes: a wall that defines a cavity, where the cavity includes a first end and a second end opposite the first end, and where the first end of the cavity is open to receive a roll of contaminant removal tape; and a slot for receiving a handle attached to the roll of contaminant removal tape, where the slot includes a first end and a second end opposite the first end, where the first end of the slot is open to receive the handle attached to the roll of contaminant removal tape, and where the second end of the slot is closed to contain the handle attached to the roll of contaminant removal tape.

BACKGROUND OF THE INVENTION

A variety of lint removal devices are known. Lint removal devices remove lint and other small particles or contaminants, such as hair or threads, from a surface, such as clothing. One known form of a lint removal device includes lint removal tape, which is used while still on a roll to remove lint and other small particles from the surface. In roll form, lint removal tape is typically wound on a core with the adhesive side of the tape wound outwardly for use. The lint removal tape roll is rolled against the surface to remove the lint and other small particles or contaminants from the surface. The lint, small particles and other contaminants adhere to the adhesive side of the lint removal tape. When the outer wrap of the lint removal tape is saturated with the lint, small particles and other contaminants, the outer wrap of the tape is removed from the roll to discard it. A roll of lint removal tape is generally used on an applicator. Examples of lint removal devices are taught in the following patents: U.S. Pat. No. 5,940,921 (Wood et al.), "Applicator for a Coreless Tape Roll;" U.S. Pat. No. 5,763,038 (Wood), "Progressively Perforated Tape Roll;" U.S. Pat. No. 5,027,465 (McKay), "Lint Remover;" and U.S. Pat. No. 4,422,201 (McKay), "Lint Remover."

Other lint removal devices are described in U.S. Pat. No. 6,055,695, U.S. Pat. No. 6,127,014, U.S. Pat. No. 5,388,300, U.S. Pat. No. 4,905,337, U.S. Pat. No. 3,906,578, and co-pending U.S. patent application Ser. No. 09/932292, "A Contaminant Removal Tape Assembly, A Roll Of Contaminant Removal Tape, And Methods Of Removing Contaminants From A Surface,"which was filed on Aug. 17, 2001.

Minnesota Mining and Manufacturing Company based in St. Paul, Minn. has sold lint rollers and roller refills in a variety of sizes under the brand name "3M" under part numbers 836, 837, and 833.

Helmac Products Corporation, based in Flint, Michigan has sold lint adhesive rollers and adhesive roller refills in a variety of sizes under the brand name "Evercare."

SUMMARY OF THE INVENTION

One aspect of the present invention provides a cover for a roll of contaminant removal tape. The cover for a roll of contaminant removal tape includes: a) a wall that defines a cavity, where the cavity includes a first end and a second end opposite the first end, and where the first end of the cavity is open to receive a roll of contaminant removal tape; and b) a slot for receiving a handle attached to the roll of contaminant removal tape, where the slot includes a first end and a second end opposite the first end, where the first end of the slot is open to receive the handle attached to the roll of contaminant removal tape, and where the second end of the slot is closed to contain the handle attached to the roll of contaminant removal tape. In one preferred embodiment of the above cover, the wall further includes: a handle-receiving portion, where the handle-receiving portion includes the slot; and a roll protection portion, where the roll protection portion includes the cavity. In one aspect of this embodiment, the handle-receiving portion includes a first side, a second side opposite the first side, and a top extending between the first side and the second side, and where the top includes the slot. In another aspect of this embodiment, the roll protection portion includes a first side, a second side opposite the first side, and a bottom extending between the first side and the second side. In yet another aspect of this embodiment, the first side and the second side of the roll protection portion are generally round. In another aspect of this embodiment, the first side and the second side of the roll protection portion are spaced so as to not contact the roll of contaminant removal tape. In yet another aspect of this embodiment, the roll protection portion includes a back side at the second end of the cavity, where the back side extends between the first side, the second side, and the bottom.

In another preferred embodiment of the above cover, the second end of the cavity is closed to contain the roll of contaminant removal tape. In yet another preferred embodiment of the above cover, the second end of the slot is configured to retain the handle attached to the roll of contaminant removal tape. In one aspect of this embodiment, the second end of the slot includes a first width and a second width, where the first width is narrower than the second width, and where the first width is closer to the first end of the slot than the second width.

In another preferred embodiment of the above cover, the slot extends approximately half-way across the cover. In another preferred embodiment of the above cover, the cover further comprises a track inside the cavity, where the track is arranged to engage with the handle attached to the roll of contaminant removal tape so as to keep the roll of contaminant removal tape from contacting the wall. In another preferred aspect of this embodiment, the track is parallel to the length of the cavity. In yet another preferred aspect of this embodiment, the cover is in combination with an applicator. In this embodiment, the applicator comprises: i) a handle having a first end and a second end opposite the first end; ii) a tape-receiving portion connected to the second end of the handle; and iii) a support guide mounted on the handle; where the handle is engaged with the slot of the cover, where the tape-receiving portion is inside the roll protection portion of the cover, and where the support guide of the applicator is engaged with the track inside the cavity. In another aspect of this embodiment, the applicator further comprises: iv) a roll of contaminant removal tape mounted on the tape-receiving portion, where the roll of contaminant removal tape is positioned in the cavity.

Another aspect of the present invention provides an alternative cover for a roll of contaminant removal tape. The cover for a roll of contaminant removal tape comprises: a) a wall that defines a cavity, where the cavity includes a first end and a second end opposite the first end, where the first end of the cavity is open to receive a roll of contaminant removal tape; and b) a track inside the cavity, where the track is arranged to engage with a handle attached to the roll of contaminant removal tape so as to keep the roll of contaminant removal tape from contacting the wall. In one preferred embodiment of the above cover, the cover further comprises: c) a slot for receiving the handle attached to the roll of contaminant removal tape, where the slot includes a first end and a second end opposite the first end, where the first end of the slot is open to receive the handle attached to the roll of contaminant removal tape, and where the second end of the slot is closed to contain the handle attached to the roll of contaminant removal tape. In one aspect of this embodiment, the wall further includes: a handle-receiving portion, where the handle-receiving portion includes the slot; and a roll protection portion, where the roll protection portion includes the cavity. In another aspect of this embodiment, the handle-receiving portion includes a first side, a second side opposite the first side, and a top extending between the first side and the second side, and where the top includes the slot. In yet another aspect of this embodiment, the roll protection portion includes a first side, a second side opposite the first side, and a bottom extending between the first side and the second side. In another aspect of this embodiment, the first side and the second side of the roll protection portion are generally round. In another aspect of this embodiment, the first side and second side of the roll protection portion are spaced so as to not contact the roll of contaminant removal tape. In yet another aspect of this embodiment, the roll protection portion includes a back side extending between the first side, the second side and the bottom.

In another preferred embodiment of the above cover, the second end of the cavity is closed to contain the roll of contaminant removal tape. In another embodiment of the above cover, the second end of the slot is configured to retain the handle attached to the roll of contaminant removal tape. In one aspect of this embodiment, the second end of the slot includes a first width and a second width, where the first width is narrower than the second width, and where the first width is closer to the first end of the slot than the second width. In another embodiment of the above cover, the slot extends approximately halfway across the cover. In another embodiment of the above cover, the track is parallel to the length of the cavity.

In another preferred embodiment of the above cover, the cover is in combination with an applicator. In this embodiment, the applicator comprises: i) a handle having a first end and a second end opposite the first end; ii) a tape-receiving portion connected to the second end of the handle; and iii) a support guide mounted on the handle; where the handle is engaged with the slot of the cover, where the tape-receiving portion is inside the roll protection portion of the cover, and where the support guide of the applicator is engaged with the track inside the cavity. In another aspect of this embodiment, the applicator further comprises: iv) a roll of contaminant removal tape mounted on the tape-receiving portion, where the roll of contaminant removal tape is positioned in the cavity.

Another aspect of the present invention provides a method of placing an applicator inside a cover. This method comprises: a) providing a cover, where the cover comprises: i) a wall that defines a cavity, where the cavity includes a first end and a second end opposite the first end, and where the first end of the cavity is open to receive a roll of contaminant removal tape; and ii) a slot for receiving a handle attached to the roll of contaminant removal tape, where the slot includes a first end and a second end opposite the first end, where the first end of the slot is open to receive the handle attached to the roll of contaminant removal tape, and where the second end of the slot is closed to contain the handle attached to the roll of contaminant removal tape; and iii) a track inside the cavity, where the track is arranged to engage with a handle attached to the roll of contaminant removal tape so as to keep the roll of contaminant removal tape from contacting the wall; b) providing an applicator, where the applicator comprises: i) a handle having a first end and a second end opposite the first end; ii) a tape-receiving portion connected to the second end of the handle; and iii) a support guide mounted on the handle; c) engaging the support guide on the handle with the track inside the cavity; and d) sliding the support guide on the handle along the track inside the cavity so as to place the applicator inside the cover.

BRIEF DESCRIPTION OF THE DRAWINGS

The present invention will be further explained with reference to the appended Figures, wherein like structure is referred to by like numerals throughout the several views, and wherein.

DETAILED DESCRIPTION OF THE INVENTION

The cover 10 of the present invention is a container that stores and protects a roll of contaminant removal tape, while a user is not using the roll of contaminant removal tape. The roll of contaminant removal tape is wrapped such that the layer of adhesive is facing outwards, away from the center of the roll. The contaminant removal tape is designed to pick up contaminants, such as lint, hair, threads, dirt or any other matter from a surface, such as a floor, ceiling, work surface, or clothing, to clean the surface. Typically, the contaminant removal tape is mounted on a handle. When a user is done using the tape to remove contaminants, he may easily slide the handle and contaminant removal tape inside the cover 10. The cover is shaped to support the handle and is shaped to keep the adhesive side of the roll from contacting the inside of the cover.

Figure 1:
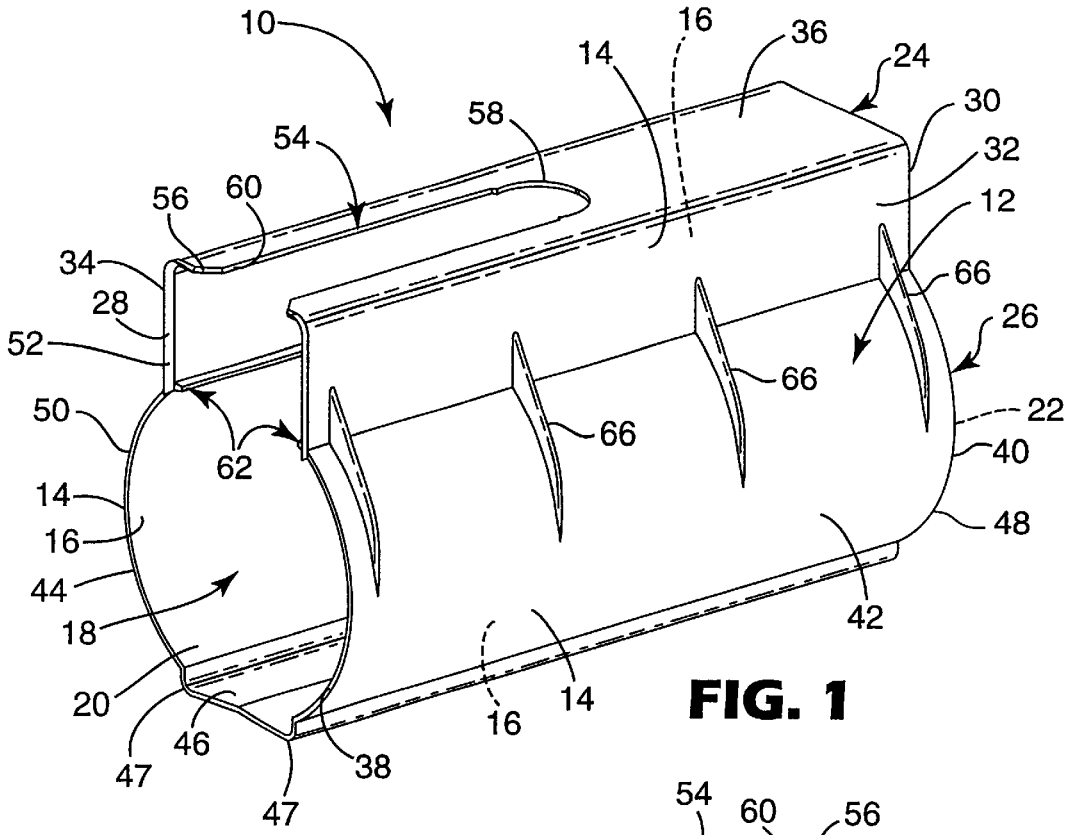
FIG. 1 is a front perspective view of one embodiment of the cover for a roll of contaminant removal tape of the present invention.
Figure 2:
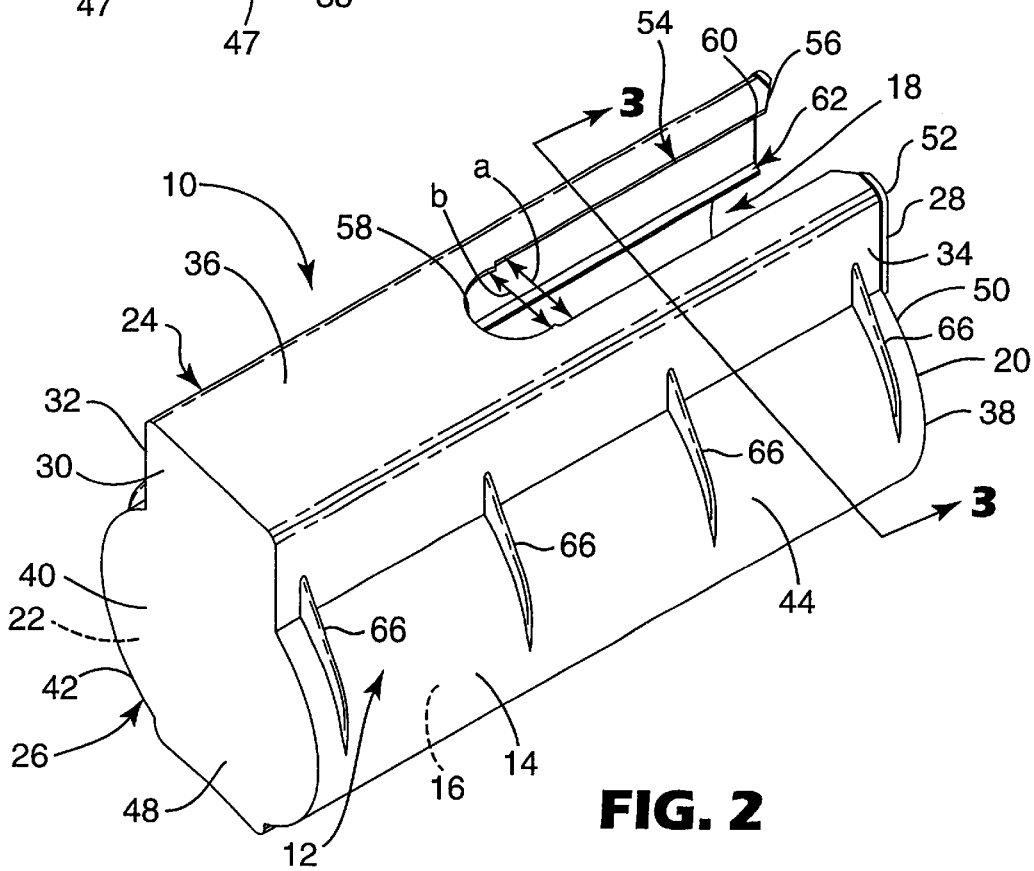
FIG. 2 is a rear perspective view of the cover of FIG. 1.

FIGS. 1 and 2 illustrate one embodiment of a cover 10 for a roll of contaminant removal tape of the present invention. A wall 12 forms the cover 10. The wall 12 has a first side 14 and a second side 16, which is opposite the first side 14. The cover 10 includes a handle-receiving portion 24 and a roll protection portion 26. The handle-receiving portion 24 is where the handle of an applicator is placed inside the cover 10. The roll protection portion 26 is where the roll of contaminant removal tape is placed inside the cover 10. Preferably, the handle-receiving portion 24 and roll protection portion 26 are interconnected, so that a roll of contaminant removal tape mounted on a handle may be inserted together into the cover 10. However, the handle-receiving portion 24 and roll protection portion 26 may be remote from each other. For example, the handle-receiving portion 24 and roll protection portion 26 may be two discrete pieces which may be separated from each other, and connected by other portions.

The second side 16 of the wall 12 defines a cavity 18 for receiving a roll of contaminant removal tape. The cavity 18 has a first end 20 and a second end 22, which is opposite the first end 20. The first end 20 of the cavity 18 includes an opening 50 for receiving the roll of contaminant removal tape. Preferably, the second end 22 of the cavity 18 is closed, as illustrated in FIG. 2, to contain the roll of contaminant removal tape. In this embodiment, the roll of contaminant removal tape is protected on all sides except for the side exposed at the opening 50 of the cavity 18. However, it is not required that the second end 22 of the cavity 18 be closed. The second end 22 of the cavity 18 may include an opening similar to the opening 50 at the first end 20 of the cavity 18.

The roll protection portion 26 of the cover 10 includes a first end 38 and a second end 40, which is opposite the first end 38. The first end 38 of the roll protection portion 26 includes the opening 50 of the cavity 18. The second end 40 of the roll protection portion 26 includes a back side 48.

The roll protection portion 26 of the cover 10 includes a first side 42 and a second side 44, which is opposite the first side 42. The roll protection portion 26 also includes a bottom 46, which extends between the first side 42 and the second side 44. Preferably, the bottom 46 is shaped to include two legs 47 for supporting the cover 10. Alternatively, the bottom may be flat. Preferably, the sides 42, 44 of the roll protection portion 26 are curved so as to closely follow the contour of the roll of contaminant removal tape. Preferably, the sides 42, 44 of the roll protection portion 26 are generally round to match the roll of contaminant removal tape. However, the sides 42, 44 of the roll protection portion 26 are not required be curved, and instead may be perpendicular to the top 36. Preferably, the sides 42, 44 are spaced wide enough apart so that the sides 42, 44 will not touch the adhesive side of the tape, when the contaminant removal tape is inserted into the roll protection portion 26.

The handle-receiving portion 24 of the cover 10 includes a first end 28 and a second end 30, which is opposite the first end 28. The first end 28 of the handle-receiving portion 24 includes an opening 52 for receiving a handle. The handle will typically have the roll of contaminant removal tape mounted on it. The second end 30 of the handle-receiving portion 26 includes the back side 48.

The handle-receiving portion 24 of the cover 10 includes a first side 32 and a second side 34, which is opposite the first side 32. The handle-receiving portion 24 also includes a top 36, which extends between the first side 32 and the second side 34. Preferably, the sides 32, 34 of the handle-receiving portion 24 are perpendicular to the top 36. The inner surfaces 16 of the sides 32, 34 of the handle-receiving portion 24 are spaced far enough apart from each other so that a handle may be inserted into the handle-receiving portion 24. Preferably, the inner surfaces 16 of the sides 32, 34 of the handle-receiving portion 24 are shaped to closely match the outside contour of the handle, so there will be a snug fit between the handle and the handle-receiving portion 24, yet allowing the handle to be moved into and out of the handle-receiving portion 24.

Figure 7:
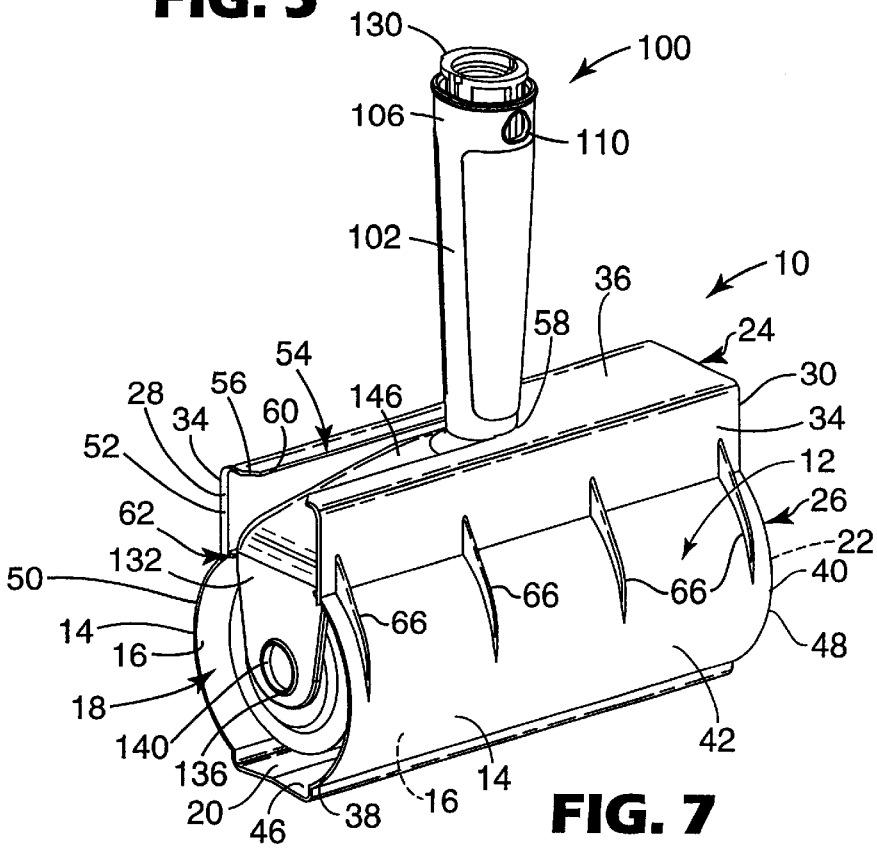
FIG. 7 is a view like FIG. 6, after the applicator and roll of contaminant removal tape are placed inside the cover.

The handle-receiving portion 24 includes a slot 54. The slot has a first end 56 and a second end 58, which is opposite the first end 56. The slot 54 extends approximately half-way across the length of the cover 10. However, the slot may extend across any length of the cover 10 or may extend across the entire length of the cover 10. The first end 56 of the slot 54 is connected with the opening 52 of the handle-receiving portion 24. This is to allow a user to fit a portion of a T-shaped handle into the handle-receiving portion 24 of the cover 10, while the length of the handle extends out through the slot, as illustrated in FIG. 7. The handle is slid in the first end 56 of the slot 54 and slides all the way into the slot until the handle reaches the second end 58 of the slot. The second end 58 of the slot 54 is curved to match the radius of a handle. Preferably a handle will snap fit into the second end 58 of the slot 54. To achieve this snap fit, the second end 58 of the slot 54 includes a first width "a" and a second width "b." The second width "b" is located between the second end 58 of the slot and the first width "a." The first width "a" is located between the first end 56 of the slot 54 and the second width "b." The first width "a" is wider than the width of the handle to allow the handle to slide easily into the slot 54. The second width "b" is approximately the width of the handle so that the handle snap fits into the second end 58 of the slot 54, as illustrated in FIG. 7. The handle will stay in this position until a user removes it from the second end 58 of the slot 54.

Other locking mechanisms known in the art or structural equivalents may be used to constrain the handle from moving in either direction, such as collar mounted inside or on top of the handle-receiving portion 24 for receiving the handle.

The cover 10 may optionally include ribs 66 extending between the roll protection portion 26 and the handle-receiving portion 24. The ribs 66 are located on the first side 14 of the wall 12. The cover 10 is illustrated as including four ribs 66 spaced equally on the first sides 32, 42 of the portions 24, 26 and four ribs 66 spaced equally on the second sides 34, 44 of the portions 24, 26.

Figure 3:
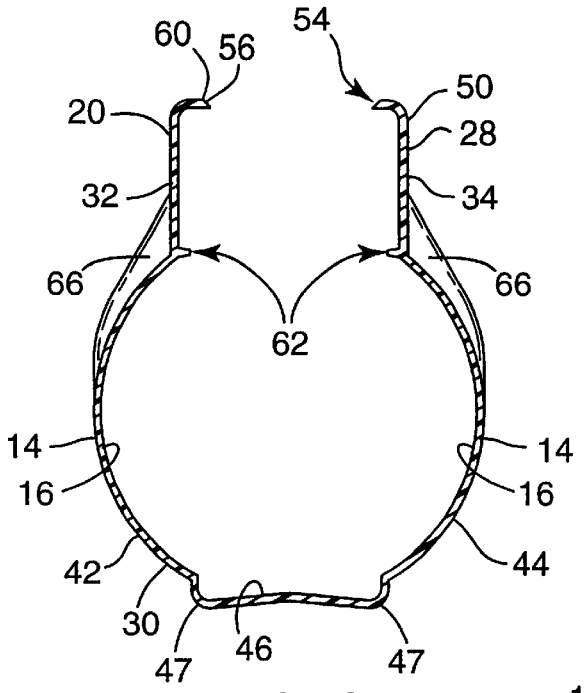
FIG. 3 is a cross-sectional view of the cover of FIG. 2 taken along section line 3—3.

FIG. 3 illustrates a cross-sectional view of the cover 10. The cover 10 includes at least one track 62 on the second side 16 of the wall 12. The cover 10 is illustrated as including two tracks 62 opposite each other and located between the roll protection portion 26 and the handle-receiving portion 24 of the cover 10. However, the cover 10 may include any number of tracks 62. Preferably, the tracks 62 are parallel relative to the top 36 and the tracks run the length of the cover 10. To insert the handle and roll of contaminant removal tape into the cover, a user first aligns the support guides 64 on the handle with the tracks 62 inside the cover. Then, the handle slides along the tracks 62 inside the cover, as explained in more detail in regard to FIGS. 6–8.

Other tracks known in the art or structural equivalents may be used to support the handle inside the cover 10, such as a grooves or notches for receiving the support guides 64 on the handle.

Figure 4:
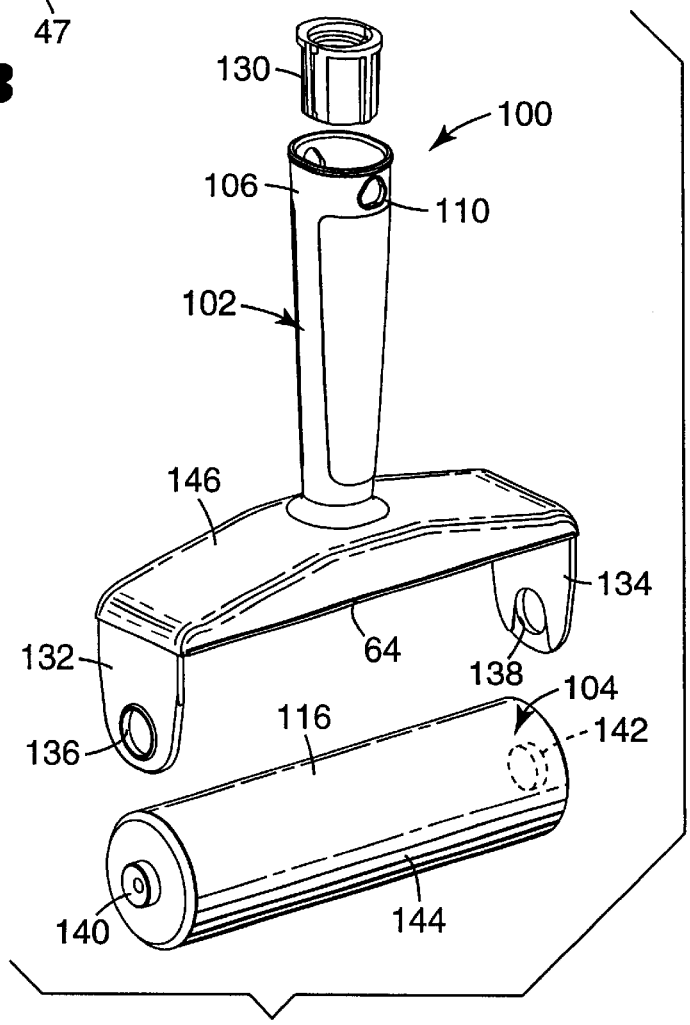
FIG. 4 is an exploded view of one embodiment of the applicator of the present invention.
Figure 5:
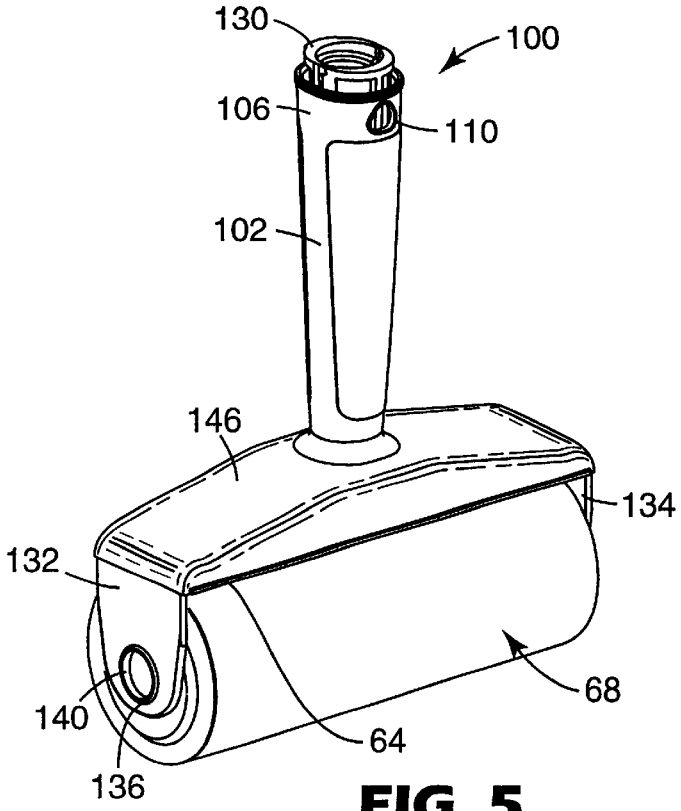
FIG. 5 is a perspective view of the applicator of FIG. 4, including a roll of contaminant removal tape.

FIGS. 4 and 5 illustrate an applicator 100 of the present invention. FIG. 5 illustrates one embodiment of the contaminant removal tape assembly, which includes the applicator 100 and a roll of contaminant removal tape 68. Applicator 100 includes a handle portion 102 and a tape-receiving portion 104. The handle portion 102 can have any shape and can be contoured to ergonomically fit a hand. The handle portion 102 has a free end 106. The free end 106 of the handle portion 102 is preferably hollow and includes an opening 110 to permit hanging the applicator 100 on a hook. The applicator 100 may optionally include an insert 130 for the free end 106 of the handle portion. This insert 130 may be used to mount the applicator 100 onto a longer handle (not shown.) The handle portion 102 also includes a bridge 146 opposite the free end 106. The bridge 146 includes a first flange 132 and a second flange 134 extending from opposite ends of the bridge 146. Each flange contains a hole 136, 138 for receiving the axles 140, 142 of the tape-receiving portion 104.

The tape-receiving portion 104 includes a roller 144, a first axle 140, and second axle 142. The first axle 140 and second axle 142 are mounted on opposite ends of the roller 144 and are preferably symmetrically mounted on the opposite ends of the roller 144. The roller 144 includes a cylindrical tape-receiving surface 116 that extends between the first axle 140 and second axle 142. The tape-receiving surface 116 provides support along substantially the entire surface of the tape roll. Preferably, there are no openings, gaps, or notches on the tape-receiving surface 116, which a tape roll 68 could catch or snag to damage the roll. However, the tape-receiving surface 116 need not be cylindrical. It could be formed of planar or curved sides meeting in edges that assist in holding the tape roll in position.

The bridge 146 of the handle portion 102 of the applicator 100 includes at least one support guide 64, which assists in supporting the applicator 100 inside the cover 10. The handle portion 102 is illustrated as having two support guides 64 opposite each other extending outwardly from the bottom edges of the bridge 146. The support guides 64 engage with the tracks 62 inside the cover 10, as explained in more detail with reference to FIGS. 6–8.

Other support guides known in the art or structural equivalents may be used to support the handle inside the cover 10, such as a grooves or notches for engaging with the tracks 62 in the cover 10.

To mount a contaminant removal tape roll 68 on the applicator 100, the flanges 132, 134 are spread apart to remove the roller 144 from the applicator 100. A new tape roll 68 is then slid onto the roller 144. Next, the tape roll 68 and roller 144 are inserted between the flanges 132, 134 of the handle 102 and the axles 140, 142 are located in holes 136, 138. The roll 68 and roller 144 may then rotate freely about the center of the roller 144, with the axles 140, 142 turning in holes 136, 138.

Figure 6:
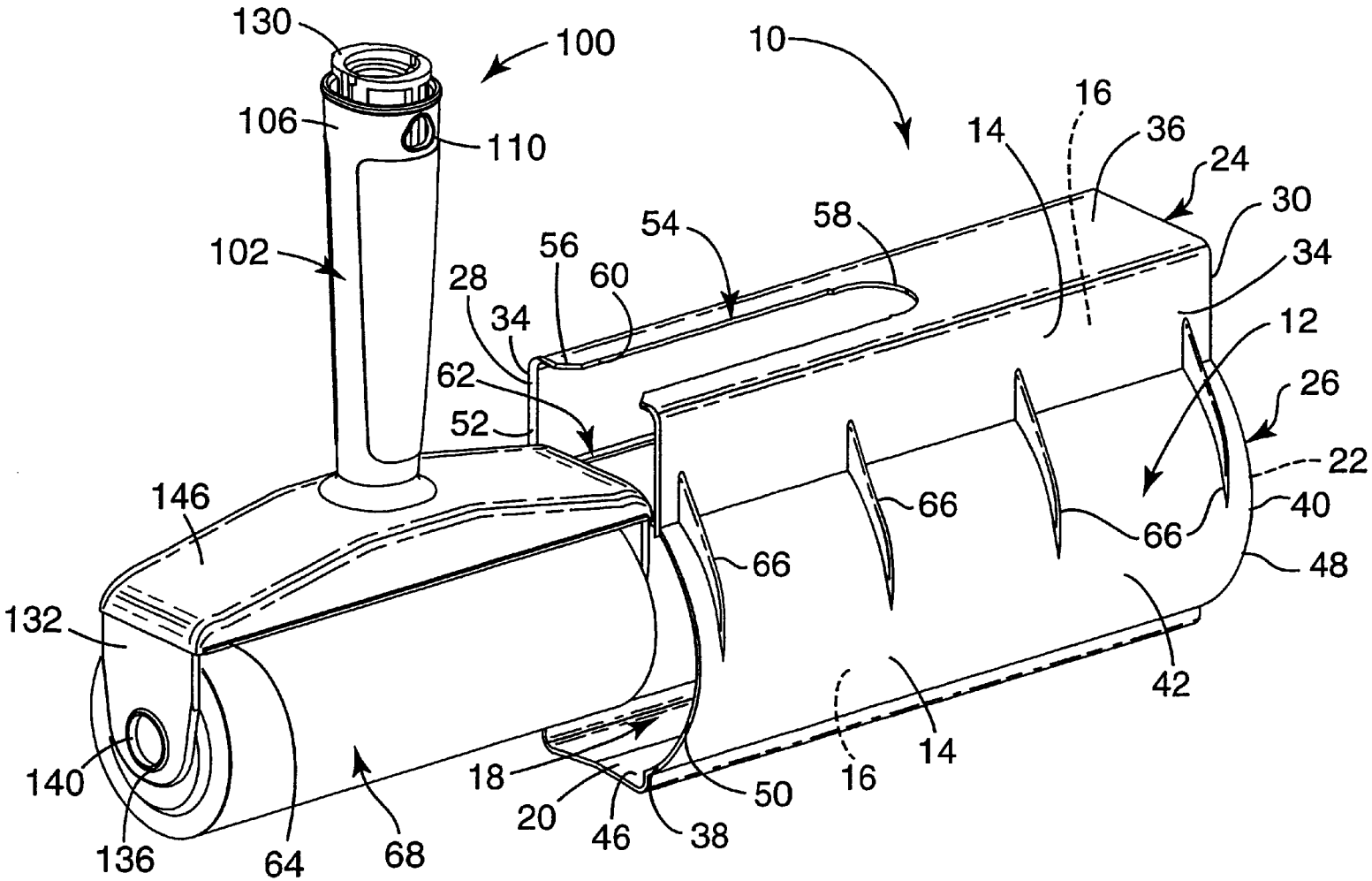
FIG. 6 is a perspective view of the applicator and roll of contaminant removal tape of FIG. 5, as it is being placed inside the cover of FIG. 1.
Figure 8:
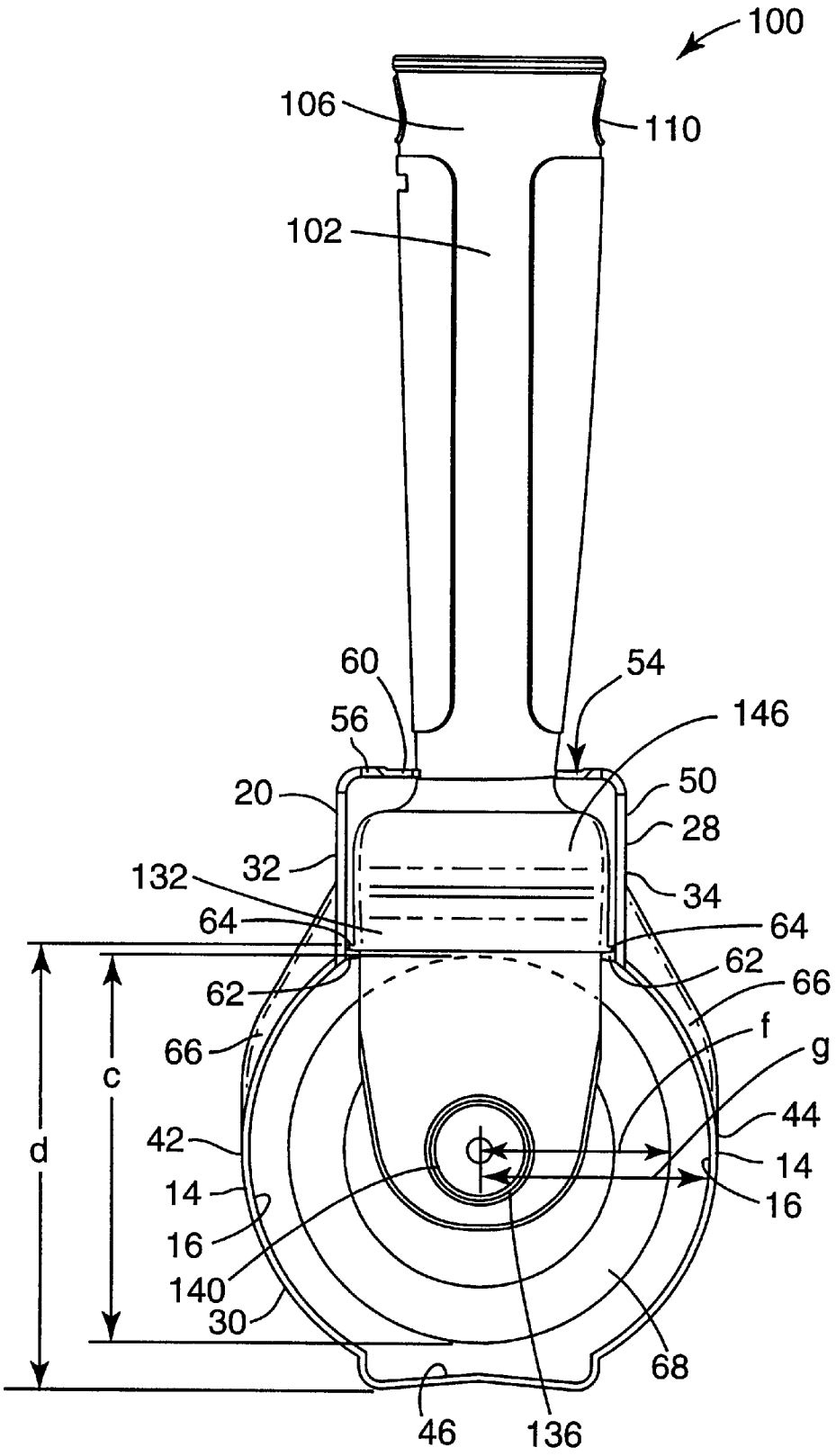
FIG. 8 is a side view of the applicator and roll of contaminant removal tape inside the cover of FIG. 1.

FIGS. 6–8 illustrate a method of placing the applicator 100 and a fill 68 of contaminant removal tape mounted on the applicator 100 inside the cover 10. To place the applicator 100 and roll 68 inside the cover 10, a user first aligns the support guides 64 on the bridge 146 of the handle portion 102 of the applicator 100 with the tracks 62 inside the cover 10, as illustrated in FIG. 6. Preferably, the applicator includes two support guides 64 that are perpendicular to the length of the handle portion 102. The support guides 64 are on opposite sides of the bridge 146 and run the length of the bridge 146. Similarly, the cover preferably includes two tracks 62 that extend in the same direction as the support guides 64. The tracks 62 are opposite each other inside the cover 10. Next, a user places the support guides 64 on the applicator 100 in contact with the tracks 62 inside the cover 10, such that the bottom of the support guide 64 are in contact with the top of the tracks 62, as illustrated in FIG. 6. At this point in time, the flange 134 of the applicator 100 and the roll of tape 68 are positioned inside the opening 50 of the cavity and are facing the second end 22 of the cavity 18. The bridge 146 is positioned inside the opening 52 of the handle-receiving portion 24. The handle portion 102 is aligned with the first end 56 of the slot 54. Next, the handle portion 102 of the applicator 100 is pulled towards the second end 58 of the slot 54. As the handle portion 102 of the applicator 100 is pulled, the support guides 64 on the bridge 145 slide along the tracks 62 inside the cover 10. Lastly, the handle portion 102 engages with the second end 58 to hold the handle portion 102 in place, as illustrated in FIG. 7. At this point in time, the tracks 62 are supporting the bridge 146 and handle portion 102 of the applicator 100. The bridge 146 is inside the handle-receiving portion 24 of the cover and the handle 102 is extending out of the cover through the second end 58 of the slot 54. The flanges, 132, 134 and the roll 68 of containment removal tape are inside the roll protection portion 26 of the cover. The roll 68 of containment removal tape does not contact the inside of the cavity 18, as illustrated in FIG. 8. To remove the applicator 100 and roll of containment removal tape 68 from the cover, a user would reverse the order of the steps described above. For example, the user could disengage the handle portion 102 from the second end 58 of the slot 54 to the first end 58 of the slot 54, and remove the applicator 100 and roll of containment removal tape 68 from the cover 10.

FIG. 8 illustrates a side view of the applicator 100 after it has been placed inside the cover 10. The support guides 64 on the handle are supporting the rest of the applicator 100 by resting against the tracks 62 inside the cover 10. The cover 10 is designed such that the roll 68 does not contact with the second side 16 of the wall 12 of the cavity 18. To accomplish this result, the cover 10 is designed such that distance between the center of the axels 140, 142 of the roller 144 and the second side 16 of the wall 12 (designated as distance "g") is greater than the radius of the roll 68 (designated as distance "f"). In addition, the cover 10 is designed such that the distance from the tracks 62 on the handle to the bottom 46 of the cover (designated as distance "d") is greater than the diameter of the roll 68. However, the tracks 62 may be mounted anywhere inside the handle-receiving portion such that the roll 68 hangs above the bottom 46 of the cover.

The cover 10 and applicator 100 may be made by blow molding, injection molding, rotary molding, thermoforming or other manufacturing methods known by those skilled in the art.

The following two paragraphs include preferred dimensions of the cover 10. However, the cover 10 may be any size to contain any shape of contaminant removal tape roll.

The cover 10 includes a height measured from the bottom 46 to the top 36 in the range of 3.8 inches to 4.0 inches (9.7 cm to 10.1 cm), and more preferably 3.91 inches (9.9 cm). The cover 10 includes a length measured from the first end 38 to the second end 40 of the roll protection portion 26 in the range of 6.5 inches to 6.7 inches (16.5 cm to 17.1 cm), and more preferably 6.64 inches (16.9 cm). The handle-receiving portion 24 of the cover 10 includes a width measured from the first side 32 to the second side 34 of the handle-receiving portion 24 in the range of 1.8 inches to 1.9 inches (4.6 cm to 4.8 cm), and more preferably 1.81 inches (4.8 cm). The cavity 18 of the cover 10 includes a radius measured from the center of the cavity 18 to the sides 42, 44 of the roll protection portion 26 in the range of 2.9 inches to 3.1 inches (7.4 cm to 7.9 cm), and more preferably 3.03 inches (7.7 cm).

The slot 54 includes a width in the range of 0.9 inches to 1.0 inches (2.3 cm to 2.5 cm), and more preferably 0.91 inches (2.3 cm). The slot 54 also includes a length in the range of 3.6 inches to 3.8 inches (9.1 cm to 9.7 cm), and more preferably 3.71 inches (9.4 cm). First width "a" of the slot 54 is in the range of 0.9 inches to 1.0 inches (2.3 cm to 2.5 cm), and more preferably 0.91 inches (2.3 cm). Second width "b" of the slot 54 is in the range of 0.8 inches to 0.9 inches (2.0 cm to 2.3 cm), and more preferably 0.81 inches (2.1 cm).

Any form of a contaminant removal tape roll or lint removal tape roll may be used on applicator 100. One example of a contaminant removal tape roll is taught in co-pending U.S. patent application Ser. No. 09/932292, "A Contaminant Removal Tape Assembly, A Roll Of Contaminant Removal Tape, And Methods Of Removing Contaminants From A Surface," filed on Aug. 17, 2001, which is hereby incorporated by reference. Another example of a lint removal tape roll is taught in U.S. Pat. No. 5,763,038, "Progressively Perforated Tape Roll."

The present invention has now been described with reference to several embodiments thereof. The foregoing detailed description and examples have been given for clarity of understanding only. No unnecessary limitations are to be understood therefrom. All patents and patent applications cited herein are hereby incorporated by reference. It will be apparent to those skilled in the art that many changes can be made in the embodiments described without departing from the scope of the invention. Thus, the scope of the present invention should not be limited to the exact details and structures described herein, but rather by the structures described by the language of the claims, and the equivalents of those structures.

What is claimed is:

1. A cover for a roll of contaminant removal tape, comprising:

a) a wall that defines an exterior and a cavity, wherein said cavity includes a first end and a second end opposite said first end, and wherein said first end of said cavity is open to receive a roll of contaminant removal tape;

b) a slot formed through said wall of said cover to said exterior, said slot for receiving a handle attached to the roll of contaminant removal tape, wherein said slot includes a first end and extends to a second end opposite said first end, wherein said first end of said slot generally corresponds to said first end of said cavity and is open to receive the handle attached to the roll of contaminant removal tape, and wherein said second end of said slot is closed to contain the handle attached to the roll of contaminant removal tape; and c) a track apart from said slot arranged to engage with the handle attached to the roll of contaminant removal tape so as to keep the roll of contaminant removal tape from contacting said wall.

2. The cover of claim 1, wherein said wall further includes:

a handle-receiving portion, wherein said handle-receiving portion includes said slot; and a roll protection portion, wherein said roll protection portion includes said cavity.

3. The cover of claim 2, wherein said handle-receiving portion includes a first side, a second side opposite said first side, and a top extending between said first side and said second side, and wherein said top includes said slot.

4. The cover of claim 2, wherein said roll protection portion includes a first side, a second side opposite said first side, and a bottom extending between said first side and said second side.

5. The cover of claim 4, wherein said first side and said second side of said roll protection portion are generally round.

6. The cover of claim 5, wherein said first side and said second side of said roll protection portion are spaced so as to not contact the roll of contaminant removal tape.

7. The cover of claim 4, wherein said roll protection portion includes a back side at said second end of said cavity, wherein said back side extends between said first side, said second side, and said bottom.

8. The cover of claim 1, wherein said second end of said cavity is closed to contain the roll of contaminant removal tape.

9. The cover of claim 1, wherein said second end of said slot is configured to retain the handle attached to the roll of contaminant removal tape.

10. The cover of claim 9, wherein said second end of said slot includes a first width and a second width, wherein said second width is narrower than said first width, and wherein said first width is closer to said first end of said slot than said second width.

11. The cover of claim 1, wherein said slot extends approximately half-way across said cover.

12. The cover of claim 1, wherein said track is inside said cavity.

13. The cover of claim 12, wherein said track is parallel to the length of said cavity.

14. The cover of claim 12 in combination with an applicator, wherein said applicator comprises:

i) a handle having a first end and a second end opposite the first end;

ii) a tape-receiving portion connected to said second end of said handle; and iii) a support guide mounted on said handle;

wherein said handle is engaged with said slot of said cover, wherein said tape-receiving portion is inside said roll protection portion of said cover, and wherein said support guide of said applicator is engaged with said track inside said cavity.

15. The combination of the cover and the applicator of claim 14, wherein said applicator further comprises:

iv) a roll of contaminant removal tape mounted on said tape-receiving portion, wherein said roll of contaminant removal tape is positioned in said cavity.

16. A cover for a roll of contaminant removal tape, comprising:

a) a wall that defines a cavity, wherein said cavity includes a first end and a second end opposite said first end, wherein said first end of said cavity is open to receive a roll of contaminant removal tape;

b) a track inside said cavity, wherein said track is arranged to engage with a handle attached to the roll of contaminant removal tape so as to keep the roll of contaminant removal tape from contacting said wall; and c) a slot apart from said track, said slot for receiving the handle attached to the roll of contaminant removal tape, wherein said slot includes a first end and extends to a second end opposite said first end, wherein said first end is open to receive the handle, wherein said slot includes a first width and a second width, wherein said second width is narrower than said first width, and wherein said first width is closer to said first end of said slot than said second width.

17. The cover of claim 16, wherein said wall further includes:

a handle-receiving portion, wherein said handle-receiving portion includes said slot; and a roll protection portion, wherein said roll protection portion includes said cavity.

18. The cover of claim 17, wherein said handle-receiving portion includes a first side, a second side opposite said first side, and a top extending between said first side and said second side, and wherein said top includes said slot.

19. The cover of claim 17, wherein said roll protection portion includes a first side, a second side opposite said first side, and a bottom extending between said first side and said second side.

20. The cover of claim 19, wherein said first side and said second side of said roll protection portion are generally round.

21. The cover of claim 20, wherein said first side and second side of said roll protection portion are spaced so as to not contact the roll of contaminant removal tape.

22. The cover of claim 19, wherein said roll protection portion includes a back side extending between said first side, said second side and said bottom.

23. The cover of claim 16, wherein said second end of said cavity is closed to contain the roll of contaminant removal tape.

24. The cover of claim 16, wherein said second end of said slot is closed and configured to retain the handle attached to the roll of contaminant removal tape.

25. The cover of claim 24, wherein said second end of said slot includes said first width and said second width.

26. The cover of claim 24, wherein said slot extends approximately half-way across said cover.

27. The cover of claim 16, wherein said track is parallel to the length of said cavity.

28. The cover of claim 24 in combination with an applicator, wherein said applicator comprises:

i) a handle having a first end and a second end opposite the first end;

ii) a tape-receiving portion connected to said second end of said handle; and iii) a support guide mounted on said handle;

wherein said handle is engaged with said slot of said cover, wherein said tape-receiving portion is inside said roll protection portion of said cover, and wherein said support guide of said applicator is engaged with said track inside said cavity.

29. The combination of the cover and the applicator of claim 28, wherein said applicator further comprises:

iv) a roll of contaminant removal tape mounted on said tape-receiving portion, wherein said roll of contaminant removal tape is positioned in said cavity.

30. A method of placing an applicator inside a cover, comprising:

a) providing a cover where said cover comprises:

i) a wall that defines a cavity, wherein said cavity includes a first end and a second end opposite said first end, and wherein said first end of said cavity is open to receive a roll of contaminant removal tape; and ii) a slot for receiving a handle attached to the roll of contaminant removal tape, wherein said slot includes a first end and a second end opposite said first end, wherein said first end of said slot is open to receive the handle attached to the roll of contaminant removal tape, and wherein said second end of said slot is closed to contain the handle attached to the roll of contaminant removal tape; and iii) a track inside said cavity, wherein said track is arranged to engage with a handle attached to the roll of contaminant removal tape so as to keep the roll of contaminant removal tape from contacting said wall;

b) providing an applicator, wherein said applicator comprises:

i) a handle having a first end and a second end opposite the first end;

ii) a tape-receiving portion connected to said second end of said handle; and iii) a support guide mounted on said handle;

c) engaging said support guide on said handle with said track inside said cavity; and d) sliding said support guide on said handle along said track inside said cavity so as to place said applicator inside said cover.

31. A combination of an applicator and a cover for a roll of contaminant removal tape, the combination comprising:

an applicator comprising:

i) a handle having a first end and a second end opposite said first end, ii) a tape-receiving portion connected to said second end of said handle, and iii) a support guide mounted on said handle, iv) a roll of contaminant removal tape mounted on said tape-receiving portion; and a cover comprising:

a) a wall that defines a cavity, wherein said cavity includes a first end and a second end opposite said first end of said cavity, wherein said first end of said cavity is open to receive said roll of contaminant removal tape, b) a track inside said cavity, wherein said track is arranged to engage with said handle so as to keep said roll of contaminant removal tape from contacting said wall, c) a slot for receiving said handle, wherein said slot includes a first end and a second end opposite said first end, wherein said slot is open to receive said handle, and wherein said second end of said slot is closed to contain said handle;

wherein said handle is engaged with said slot of said cover, wherein said tape-receiving portion is positioned inside said cavity of said cover, wherein said roll of contaminant removal tape is disposed in said cavity, and wherein said support guide of said applicator is engaged with said track inside said cavity.

* * * * *

UNITED STATES PATENT AND TRADEMARK OFFICE

CERTIFICATE OF CORRECTION

PATENT NO. : 6,688,464 B2
DATED : February 10, 2004
INVENTOR(S) : Jessen, Todd J.

It is certified that error appears in the above-identified patent and that said Letters Patent is hereby corrected as shown below:

Column 5,
Line 38, insert -- to -- following "required".
Line 49, delete "26" and insert -- 24 --.

Column 6,
Line 53, delete "a" preceding "grooves".

Column 7,
Line 32, delete "a" preceding "grooves".
Line 44, delete "fill" and inset -- roll --.
Line 58, delete "guide" and insert -- guides --.

Column 8,
Line 2, delete "145" and insert -- 146 --.
Lines 10, 12, 14 and 18, delete "containment" and insert -- contaminant --.
Line 26, delete "axels" and insert -- axles --.

Signed and Sealed this

Twenty-eighth Day of December, 2004

JON W. DUDAS
*Director of the United States Patent and Trademark Office*